US007311388B2

(12) United States Patent
Ogura et al.

(10) Patent No.: US 7,311,388 B2
(45) Date of Patent: Dec. 25, 2007

(54) LIQUID SUPPLYING APPARATUS AND LIQUID HOUSING CONTAINER

(75) Inventors: Hideki Ogura, Kanagawa (JP); Ryoji Inoue, Kanagawa (JP); Ryoichi Matsumoto, Tokyo (JP); Shogo Kawamura, Shizuoka (JP); Satoshi Oikawa, Kanagawa (JP)

(73) Assignee: Canon Kabsuhiki Kaisha, Tokyo (JP)

( * ) Notice: Subject to any disclaimer, the term of this patent is extended or adjusted under 35 U.S.C. 154(b) by 353 days.

(21) Appl. No.: 11/140,918

(22) Filed: Jun. 1, 2005

(65) Prior Publication Data

US 2005/0270342 A1 Dec. 8, 2005

(30) Foreign Application Priority Data

Jun. 7, 2004 (JP) ..... 2004-169111

(51) Int. Cl.
*B41J 2/175* (2006.01)

(52) U.S. Cl. ..... 347/87; 347/86

(58) Field of Classification Search ..... 347/49, 347/85, 86, 87
See application file for complete search history.

(56) References Cited

U.S. PATENT DOCUMENTS 4,907,019 A * 3/1990 Stephens ..... 347/86
5,920,333 A * 7/1999 Bates ..... 347/85
6,158,854 A 12/2000 Watts et al. ..... 347/86

FOREIGN PATENT DOCUMENTS

| | | |
|---|---|---|
| JP | 52-150031 | 12/1977 |
| JP | 63-178141 | 11/1988 |
| JP | 6-34108 | 9/1994 |
| JP | 11-245431 | 9/1999 |

* cited by examiner

*Primary Examiner*—Anh T. N. Vo
(74) *Attorney, Agent, or Firm*—Fitzpatrick, Cella, Harper & Scinto

(57) ABSTRACT

It is an object of the present invention to provide a liquid supplying apparatus which enables a liquid housing container to be appropriately and smoothly attached to and detached from a print head. Thus, the present invention includes a liquid supplying tube projected from the print head and having a liquid introducing port which is in communication with the print head, a seal member rotatably movably held on the liquid supplying tube, the seal member being movable from a position at which the liquid introducing port is closed to a position at which the liquid introducing port is opened, a housing container main body in which the liquid is housed, the housing container main body having a liquid supplying port into and from which the liquid supplying tube can be inserted and removed, and a movable member which rotatably moves the seal member.

10 Claims, 12 Drawing Sheets

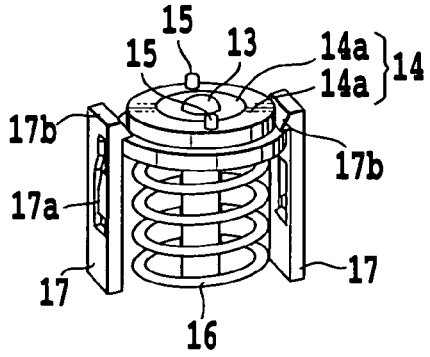
FIG.6A1
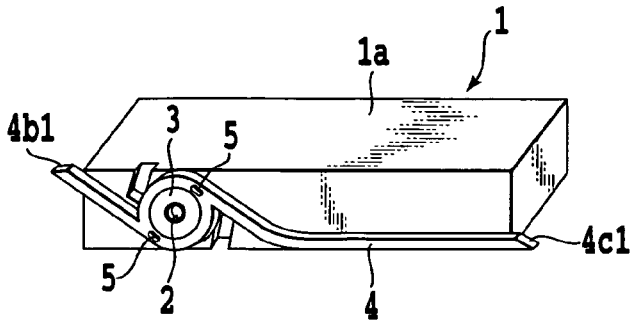
FIG.6A2
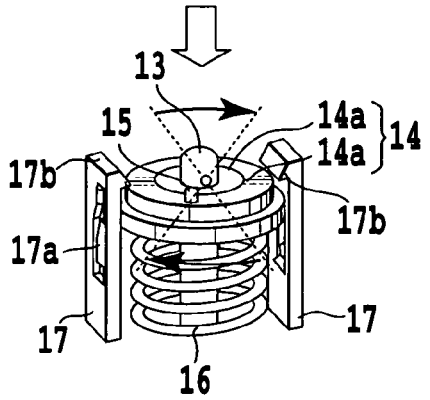
FIG.6B1
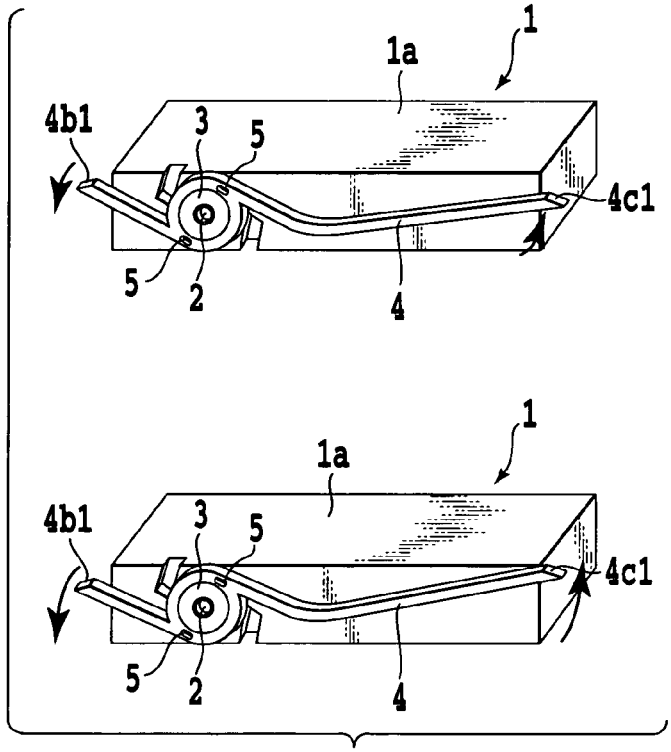
FIG.6B2
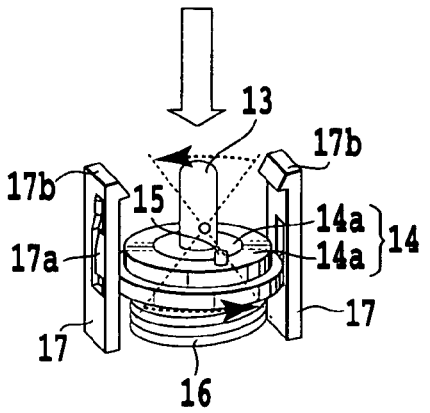
FIG.6C1
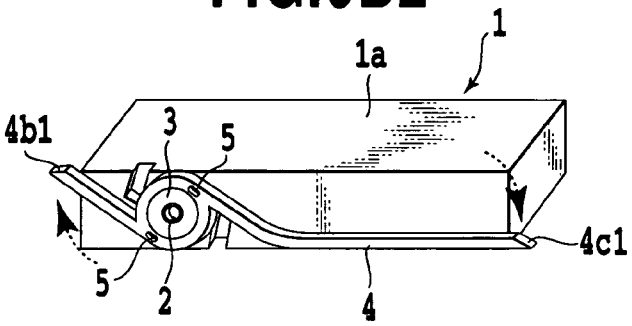
FIG.6C2

LIQUID SUPPLYING APPARATUS AND LIQUID HOUSING CONTAINER

BACKGROUND OF THE INVENTION

1. Field of the Invention

The present invention relates to a liquid supplying apparatus that supplies a liquid to a print head, and in particular, a liquid supplying apparatus having a liquid housing container detachable from the print head.

2. Description of the Related Art

Ink jet printing apparatuses form an image on a print medium by using a print head to eject a liquid such as ink or a solvent to the print medium. The ink jet printing apparatus includes a serial printer type and a line printer type. A serial printer type printing apparatus forms an image by ejecting the liquid while intermittently conveying the print medium and when the print medium is stopped, moving the print head together with a carriage in a direction orthogonal to a conveying direction. Further, a line printer type printing apparatus has an elongate print head fixed to the main body of the apparatus and consisting of nozzles arranged over at least the maximum print range of the print medium. Thus, the line printer type printing apparatus forms an image by ejecting the liquid from the print head while moving the print medium with respect to the print head.

What is called an on-carriage system is applied to the serial printer type printing apparatus in order to supply the liquid to the print head. With this system, a liquid housing container is integrally and inseparably or separably attached to the print head mounted on a carriage or the like and reciprocate (main scanning). The liquid from the liquid housing container is supplied directly to the print head.

Further, with what is called a tube supplying system, the liquid is supplied by fixedly installing the liquid housing container in another site of the printing apparatus and connecting the liquid housing container and the print head together. The tube supplying system includes a form in which a second liquid housing container functioning as a subtank between the liquid housing container (main tank) and the print head is mounted on the print head or carriage. In this form, the liquid in the second liquid housing container is supplied directly to the print head.

These liquid supplying systems are provided with a mechanism that generates a negative pressure inside the liquid housing container from which the liquid is fed directly to the print head. The negative pressure generating mechanism generates a negative pressure to the extent that the liquid is prevented from leaking inadvertently from a liquid ejecting section of the print head, while the print head can perform an ejecting operation.

When a liquid supply port in the liquid housing container is connected to a liquid supplying section provided in the head, the liquid from the liquid housing container is supplied to nozzles in the print head. Further, an ejection energy generating element (heater or piezoelectric element) is provided in each of the nozzles arranged in the print head; the ejection energy is used to eject ink. The ejection energy generating element is driven in response to a signal from the printing apparatus main body to eject the ink to a print medium to form an image.

Common means for connecting the print head and the liquid housing container together have such configurations as described below.

Japanese Utility Model Application Publication No. 6-34108 discloses an arrangement in a connection structure composed of the liquid supplying tube (needle) and an elastomer (rubber portion), the arrangement allowing the needle to be appropriately inserted into an ink cartridge. In this connection structure, the needle 6 is attached to a needle fulcrum that rotatably supports the needle 6 so as to absorb a shift in or the inclination of the needle. Moreover, in this connection structure, for improved aligning accuracy, alignment is carried out using a needle guide provided at a position closer to the leading end of the needle than to the fulcrum.

This conventional technique executes alignment of the needle with the elastomer near the needle in order to more accurately set the position into which the needle is inserted. After the alignment, the needle is rotatably supported on the needle fulcrum so as to be smoothly guided to a needle seal holding member. However, this conventional technique has no needle seal structure and does not give sufficient considerations for detachment or a fixing technique. Thus, when the ink cartridge is removed, the liquid may leak. Further, since the needle is held by the repulsive force of the elastomer around the needle, the durability of the needle may be affected or creep may occur. Further, the above publication mentions the rotatability of the needle fulcrum, but does not clearly describe a specific mechanism for making the needle fulcrum rotatable. It also fails to clarify the effects of the rotatability.

Further, Japanese Patent Laid-Open No. 1977-150031 discloses a configuration in which concave and convex portions are formed near the head supply port and interlock with concave portions provided on the tank. With this configuration, after the needle is inserted into the tank, the tank itself is rotated to fix the tank and the print head.

The technique disclosed in Japanese Patent Laid-Open No. 1977-150031 requires the housing container to be precisely mounted to the liquid supply tube in order to interlock the concaves in a peripheral portion of the head supplying port with the convexes on the liquid housing container. Further, with this technique, after the tank is inserted around the needle, the tank must be manually rotated. This degrades operability. Moreover, the housing container is cylindrical and a large dead space is thus expected to be created in the printer main body.

Japanese Patent Laid-Open No. 1977-150031 also discloses a seal member 14 that seals the liquid supplying tube to the head. However, the rotation of the container disclosed in this publication is carried out after the container has been completely inserted around the needle. Thus, the seal member may be stuck to the liquid supplying tube to increase an operating force required to rotate the container.

Japanese Patent Laid-Open No. 1999-245431 discloses an arrangement that prevents the leakage of the liquid or installation errors. In this arrangement, a cam surface is provided on the liquid housing container. To install the liquid housing container, a bayonet connector that can rotatably move relative to the main body is rotated along the cam surface to fix the liquid housing container. According to Japanese Patent Laid-Open No. 1999-245431, the rotative moving member, which rotatably moves in association with installation, is provided on the head. The characteristic shape of the rotative moving member allows installation errors to be prevented. Further, rotation of the rotative moving member improves the fixture and sealing.

However, Japanese Patent Laid-Open No. 1999-245431 requires the whole liquid housing container to be rotated when it is to be removed. This degrades the operability. Another problem with Japanese Patent Laid-Open No. 1999-245431 is that since the disclosed housing container is a rectangular parallelepiped, an extremely large dead space may be created when the housing container is removed.

Further, Japanese Utility Model Laid-Open No. 1988-178141 discloses an arrangement intended to prevent the ink from scattering (leaking) by rotating the liquid housing container 1 in order to remove it. In this arrangement, a releasing projection is provided on the tank so that the head and the tank can be rotatably moved relative to each other so as to be separated from each other. When the tank is rotatably moved, the projection operates like a cam to separate the head from the tank.

However, with the structure described in Japanese Utility Model Laid-Open No. 1988-178141 and which allows the attachment and detachment of the liquid housing container to and from the print head, the whole liquid housing container must be rotated during an attaching or detaching operation. This disadvantageously degrades the operability and results in a larger dead space in the main body.

As described above, with the arrangements shown in the above publications and provided for the connection between the print head and the liquid supplying tube to the print head, an increase in installing force required may result from the sticking of the seal portion to the liquid supplying tube to the head, the misalignment between the seal portion and the liquid supplying tube, or the like. Further, disadvantageously, the liquid housing container may be tilted during attachment or detachment, thus degrading the operability.

SUMMARY OF THE INVENTION

It is an object of the present invention to provide a liquid supplying apparatus that enables a liquid housing container to be appropriately and smoothly attached to and detached from a print head.

To achieve this object, the present invention has the following configuration.

A first aspect of the present invention is a liquid supplying apparatus which supplies a liquid to a print head, the apparatus being characterized by comprising a liquid supplying tube projected from the print head and having a liquid introducing port which is in communication with the print head, a seal member rotatably movably held on the liquid supplying tube, the seal member being movable from a position at which the liquid introducing port is closed to a position at which the liquid introducing port is opened, a housing container main body in which the liquid is housed, the housing container main body having a liquid supplying port into and from which the liquid supplying tube can be inserted and removed, and a movable member which rotatably moves the seal member.

A second aspect of the present invention is a liquid housing container from which a liquid is fed via an ink liquid supplying tube to a print head having a liquid introducing port formed in the liquid supplying tube and which can be closed by a seal member rotatably movably supported on the liquid supplying tube, the container being characterized by comprising a housing container main body having a liquid supplying port into and from which the liquid supplying tube can be inserted and removed, and a movable member which rotatably moves the seal member.

A third aspect of the present invention is a driving force transmitting member which rotatably moves the seal member in association with an operation of attaching or detaching a liquid housing container from which a liquid is fed via the ink liquid supplying tube to a print head having a liquid introducing port formed in the liquid supplying tube and which can be closed by a seal member rotatably movably supported on the liquid supplying tube, the transmitting member being characterized by comprising an engaging portion which can be engaged with the seal member and in that the transmitting member is supported so as to be rotatably movable relative to the liquid housing container.

A fourth aspect of the present invention is a method for attaching and detaching a liquid housing container, the method being used to attach and detach a liquid housing container from which a liquid is fed via the ink liquid supplying tube to a print head having a liquid introducing port formed in the liquid supplying tube and which can be closed by a seal member rotatably movably supported on the liquid supplying tube, the method being characterized by comprising a step of engaging a rotatably movable driving transmitting member with the seal member, the driving transmitting member comprising an engaging portion which can engage with the seal member, a step of lowering the seal member while rotatably moving the driving transmitting member, a step of fixing the driving transmitting member, and a step of connecting the liquid housing container to a liquid supplying tube.

According to the present invention, during an attaching and detaching operation, the movable member rotates the seal member to enable the suppression of fixation of the seal portion caused by ink evaporation and of an increase in installation force caused by, for example, sticking of the seal member. Therefore, the liquid housing member can be easily and smoothly installed.

The above and other objects, effects, features and advantages of the present invention will become more apparent from the following description of embodiments thereof taken in conjunction with the accompanying drawings.

BRIEF DESCRIPTION OF THE DRAWINGS

FIG. 6A1 is a perspective view showing how the rotative moving member operates in the step shown in FIG. 5A;

FIG. 6A2 is a perspective view showing how the seal member operates in the step shown in FIG. 5A;

FIG. 6B1 is a perspective view showing how the rotative moving member operates in the step shown in FIG. 5B;

FIG. 6B2 is a perspective view showing how the seal member operates in the step shown in FIG. 5B;

FIG. 6C1 is a perspective view showing how the rotative moving member operates in the step shown in FIG. 5C;

FIG. 6C2 is a perspective view showing how the seal member operates in the step shown in FIG. 5C;

DETAILED DESCRIPTION OF PREFERRED EMBODIMENTS

The present embodiment will be described by taking the case of a liquid housing container detachably provided in a print head used in such a serial printer type ink jet printing apparatus as previously described. In a common serial printer type ink jet printing apparatus, one or more liquid housing containers can be installed depending on the number of types of liquids used. However, for convenience, the embodiment will be described below by taking the case in which one liquid housing container is installed in the print head.

First Embodiment

A first embodiment of the present invention will be described below in detail with reference to the drawings.

Figure 1:
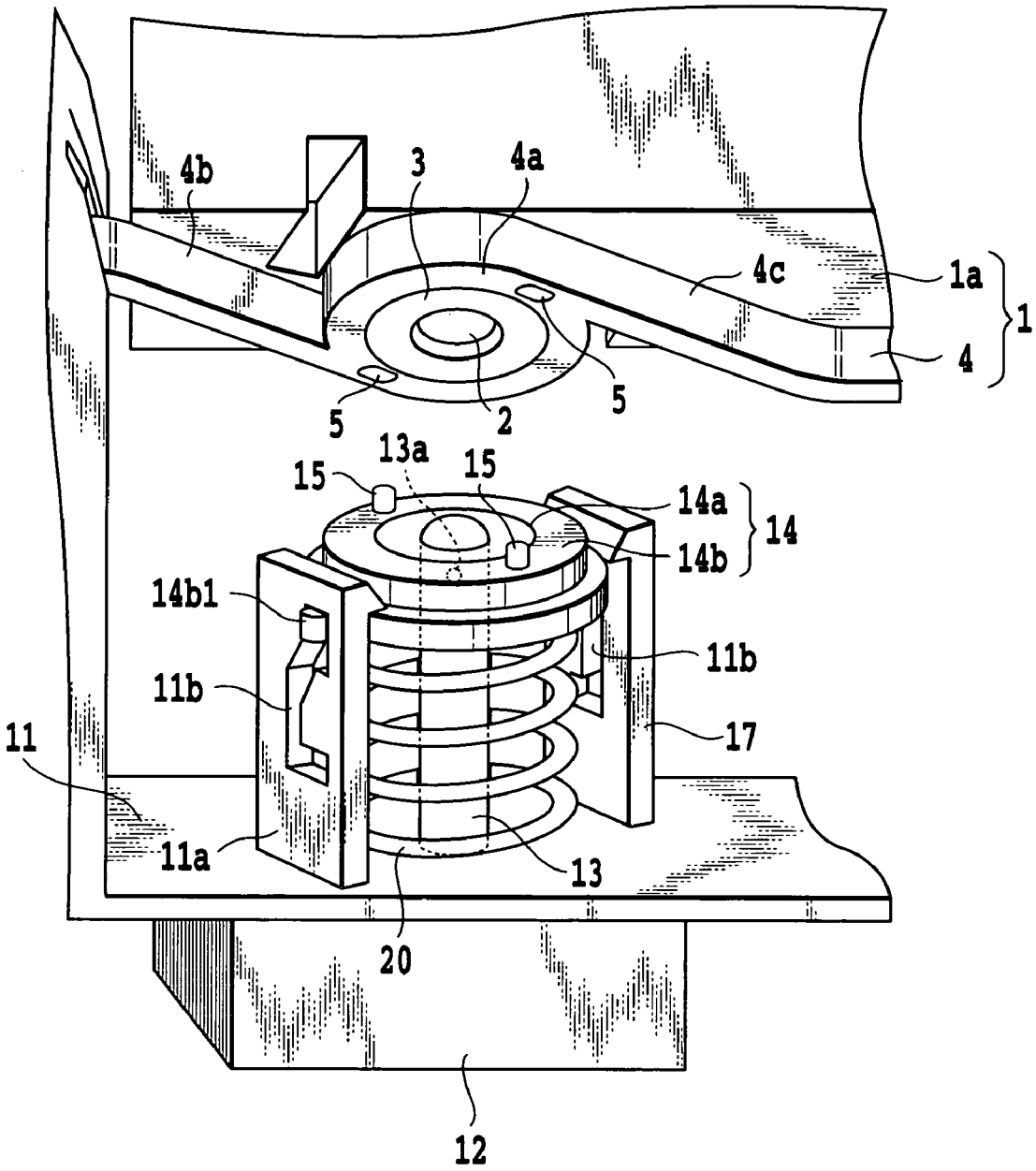
FIG. 1 is a perspective view showing an essential part of an installing structure used to detachably install a liquid housing container 1 on a print head according to a first embodiment of the present invention.
Figure 2A:
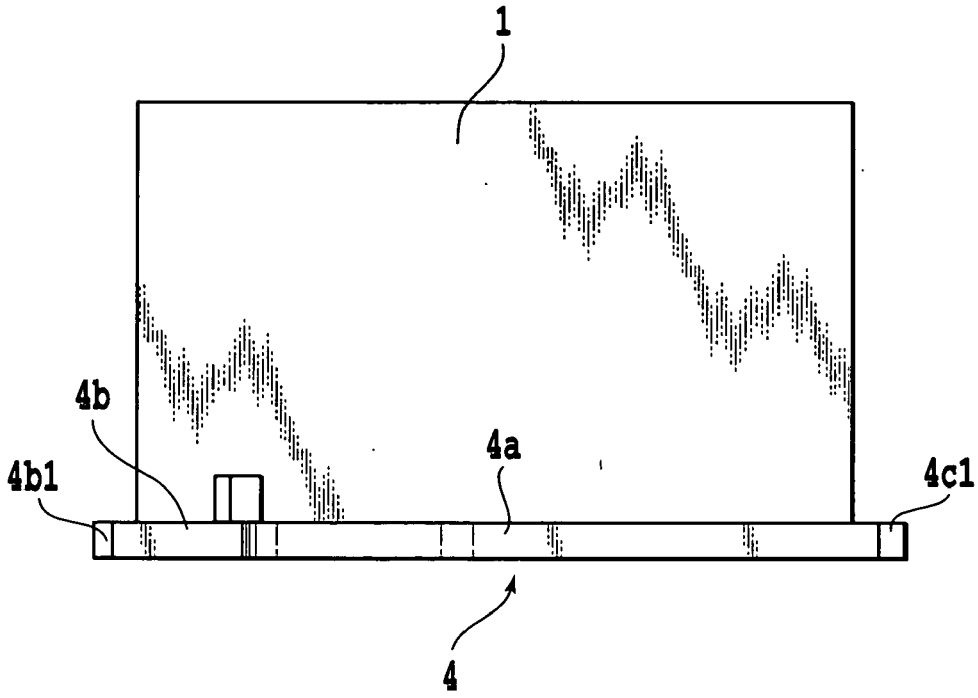
FIG. 2A is a side view showing the general configuration of a liquid storing container.
Figure 2B:
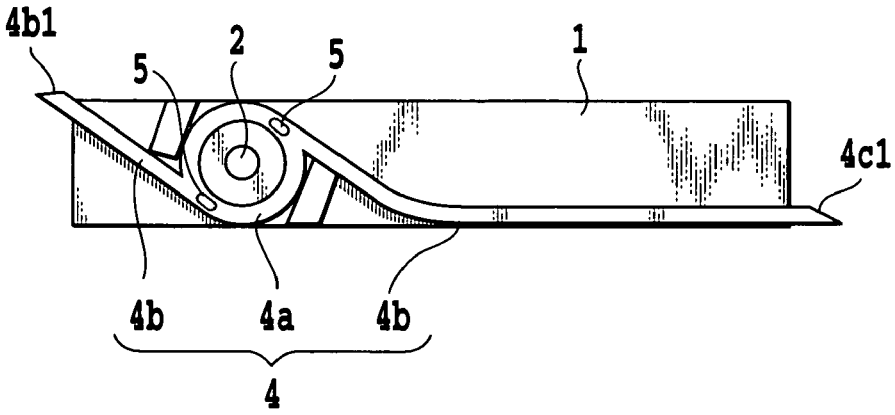
FIG. 2B is a bottom view showing the general configuration of the liquid storing container.

FIG. 1 is a perspective view showing an essential part of an installing structure used to detachably install a liquid housing container 1 on a print head 12 according to a first embodiment of the present invention. FIGS. 2A and 2B are diagrams showing the general configuration of a liquid storing container. FIG. 2A is a side view and FIG. 2B is a bottom view.

In FIG. 1, the liquid housing container 1 consists of a housing container main body 1*a* that houses a liquid and a rotative moving member (also referred to as a movable member or driving force transmitting member) 4 provided on a bottom surface of the housing container main body 1*a*.

The housing container main body 1*a* is shaped like a rectangular parallelepiped as shown in FIG. 2. The housing container main body 1*a* has a supplying port 2 formed in its bottom surface and having a diameter of about 2 to 3 mm which allows a liquid supplying tube 13 to be inserted into the supplying port 2. The supplying port 2 is closed by a bulkhead (not shown) consisting of an elastic member. A slit is formed in the bulkhead. In this embodiment, a closing member such as a ball is elastically pressed against the slit in the bulkhead to maintain a liquid-tight state. However, the supplying port 2 has only to allow the liquid supplying tube 13 to be inserted into itself. For example, the slit may be simply formed in the bulkhead consisting of an elastomer so that the closed state can be maintained by the elastic force of the elastomer. Further, an outward projecting ring-like annular projection (not shown) is formed around the periphery of the supplying port 2. An appropriate negative pressure is applied to the housing container main body 1*a* to hold a liquid in the print head 12.

The rotative moving member 4 consists of an annular portion 4*a* rotatably movably fitted and held around an annular projection projected from a bottom surface of the housing container main body 1*a* and two arm portions 4*b* and 4*c* projected from the annular portion 4*a* and having different lengths. As shown in FIG. 2B, the arm portions 4*a* and 4*b* have lengths set so that their ends 4*b*1 and 4*c*1 project outward from a right and left sides of the housing container main body 1*a*. A pair of engaging concave portions (engaged portions) 5 is formed at circumferentially opposite positions on a bottom surface of the annular portion 4*a* of the rotative moving member 4. Moreover, the rotative moving member 4 is urged clockwise around the supplying port 2 by a coil spring (not shown). This urging force causes one 4*c* of the arms to be always held along one side of the housing container main body 1*a* as shown in FIG. 2B.

On the other hand, a print head according to the present embodiment is an ink jet print head in which electrothermal converting elements (heaters) or electromechanical converting elements (piezoelectric elements) in a plurality of nozzles that eject a liquid are driven to eject the liquid from the nozzles, the liquid being fed from a liquid chamber formed in side the print head to the nozzles. A liquid supplying tube 13 is provided on a top surface of the print head 12 so as to extend in a direction orthogonal to the top surface. A lower end of the liquid supplying tube 13 is in communication with the liquid chamber in the print head 12. Further, a holder 11 holding the liquid housing container 1 is fixed to the top surface of the print head. The liquid supplying tube 13 is inserted through a through-hole formed in a bottom portion of the holder 11, and projects upward from the bottom portion.

Further, a seal member 14 is inserted around the liquid supplying tube 13 in order to prevent the leakage of a liquid from the print head 12. The seal member 14 is composed of a seal member inserted around the liquid supplying tube 13 so as to be movable along the liquid supplying tube 13 in its axial direction and rotative moving direction, and a holding member 14*b* that holds the periphery of the seal member. A pair of engaging projections (engaging portions) 15 is formed on a top surface of the holding member 14*b*; the engaging projections 15 can engage with engaging concave portions 5 in the rotative moving member 4. Moreover, a pair of protruding portions 14*b*1 are provided at opposite positions on a peripheral portion of the holding member 14*b*. Each of the paired protruding portions 14*b*1 is movably inserted into a corresponding one of paired bent grooves 17*a* extending vertically in the seal holding member 17 projected from the top surface of the holder. A coil spring 16 is elastically installed between the holding member 14*b* of the seal member 14 and the holder. The urging force of the coil spring 16 always urges the seal member 14 upward. Thus, if the liquid housing container is not installed, that is, if no downward pressing force is exerted on the seal member 14, the projecting portion 14*b*1 is held at a portion where it abuts against an upper end of the groove 17*a*. In this state, an inner peripheral surface of the elastomer 14*a* closes the liquid introducing port 13*a* to prevent the leakage of a liquid from the liquid introducing port 13*a*.

Figure 3A:
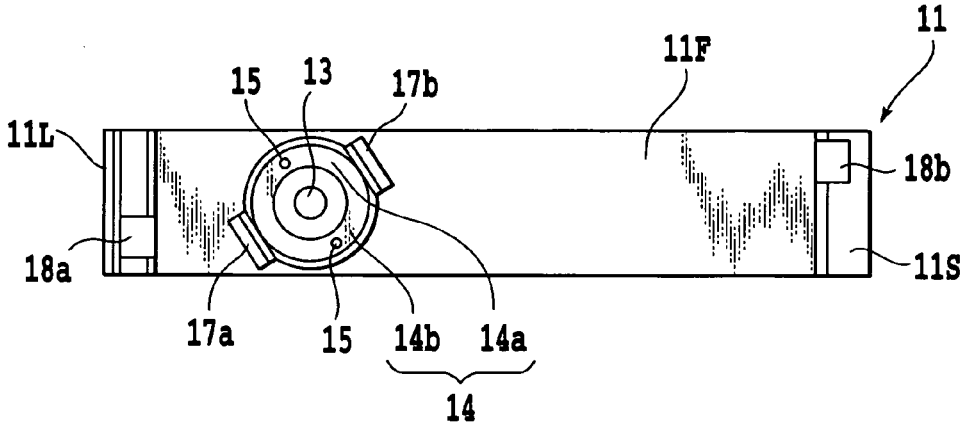
FIG. 3A is a bottom view showing the general configuration of the print head and a holder provided on the print head according to the first embodiment of the present invention.
Figure 3B:
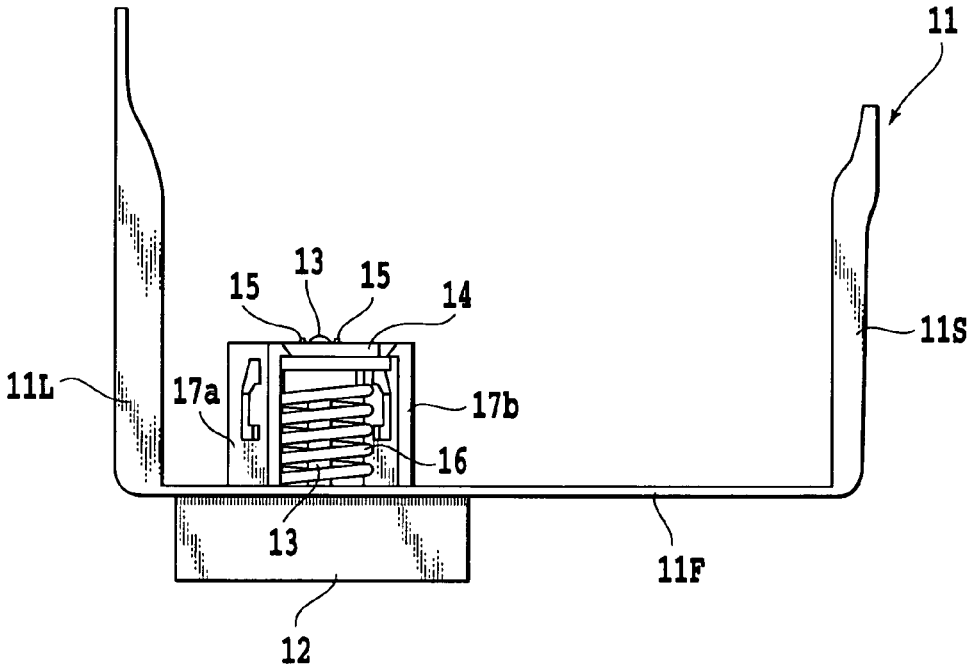
FIG. 3B is a side view showing the general configuration of the print head and the holder provided on the print head according to the first embodiment of the present invention.

FIGS. 3A and 3B are diagrams showing the general configuration of the print head 12 and the holder 11 provided on the print head. FIG. 3A is a bottom view, and FIG. 3B is a side view.

As shown FIG. 3B, the holder 11, fixed to the top surface of the print head 12, has a flat bottom surface 11F and sides 11L and 11R extending perpendicularly to the longitudinally opposite ends of the bottom surface 11F and having different lengths. Further, as shown in FIG. 3B, guide grooves 18 and 19 are formed in inner surfaces of the sides 11L and 11S of the holder 11. When the liquid housing container 1 is installed, the ends 4*b*1 and 4*c*1 of the rotative moving member 4 are inserted through the guide grooves 18 and 19, respectively.

Figure 4A:
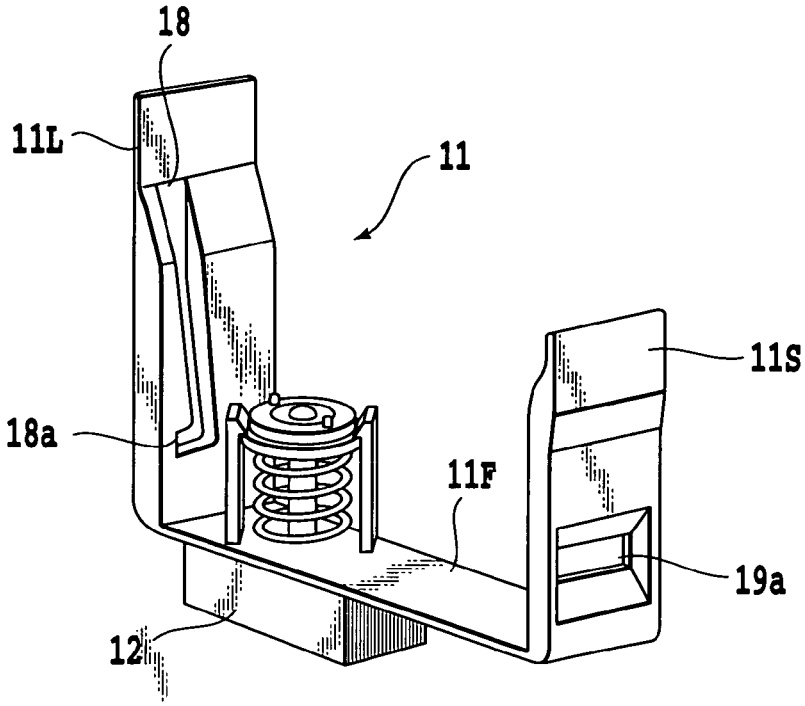
FIG. 4A is a perspective view showing the shape of a guide groove in the holder according to the first embodiment of the present invention, the guide groove being formed in an inner surface of one side.
Figure 4B:
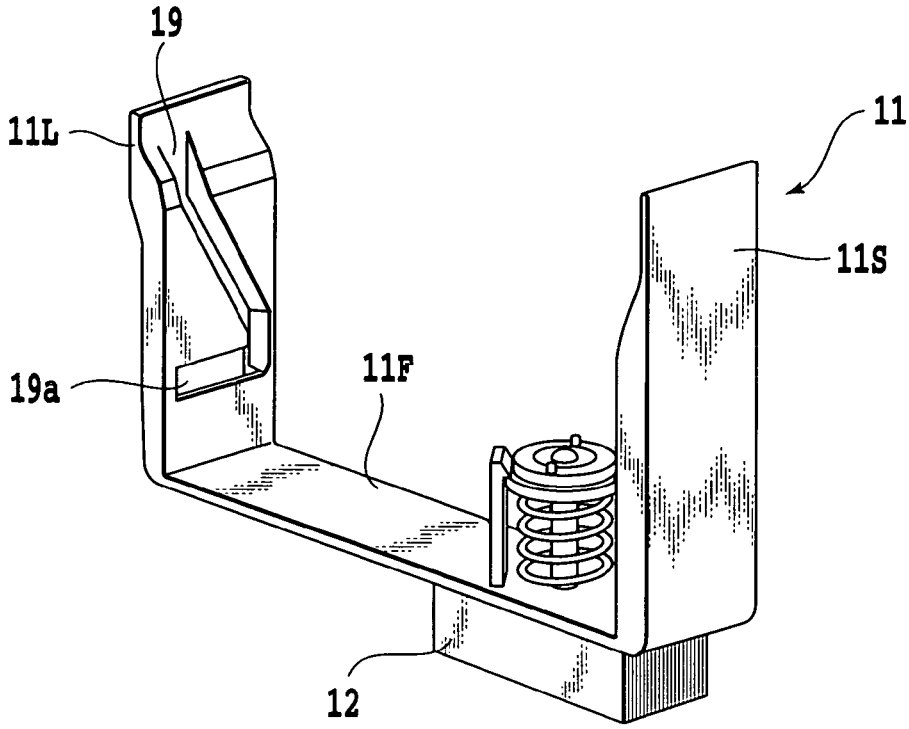
FIG. 4B is a perspective view showing the shape of a guide groove in the holder according to the first embodiment of the present invention, the guide groove being formed in an inner surface of the other side.

FIGS. 4A and 4B are diagrams showing the shape of the guide grooves 18 and 19. FIG. 4A shows the guide groove 18 formed in an inner surface of one 11L of the sides. FIG. 4B shows the guide groove 19 formed in an inner surface of the other side 11S.

As shown in FIG. 4A, the side 11L, located closer to the liquid supplying tube 13, forms a groove inclining at a relatively small angle. In contrast, the side 11S forms a groove inclining at a relatively large angle to a direction (horizontal direction) parallel to a bottom surface of the groove holder. Lower ends of the guide grooves 18 and 19 are bent at acute angles. Further, the lower end 19*a* of one 19 of the guide grooves forms an opening penetrating from inner surface to outer surface. Thus, an end 4*b*1 of the arm portion 4*b* can project outward through the opening 19*a*.

Now, description will be given of operations performed when the liquid housing container configured as described above is attached or detached.

First, description will be given of operations performed when the liquid housing container 1 is installed.

The liquid housing container 1 is installed in the holder 11, shown in FIG. 4, from above in the figure. The liquid housing container 1 is installed by inserting the opposite ends 4*b*1 and 4*c*1 of the rotative moving member 4 of the liquid housing container 1 into the upper ends of the guide grooves 18 and 19, respectively, shown in FIG. 2, and then lowering the housing container main body 1*a*. In this case, the housing container main body 1*a* is guided to the vicinity of the liquid supplying tube 13 along the guide grooves 18 and 19, formed in the holder 11, with the positions of sides of the housing container main body 1*a* roughly regulated by the longitudinal sides of the holder 11. This improves aligning precision to reduce the misalignment between the liquid supplying tube 13 of the print head 1 and the supplying port 2 in the liquid housing container 1. Further, the long moving distance of the rotative moving member 4 allows the liquid housing container 11 to be stably fixed to the guide groove 19, located closer to the operating user.

As the housing container main body 1*a* is pressed downward, the ends 4*b*1 and 4*c*1 of the rotative moving member 4 lower along the guide grooves 18 and 19, respectively, and rotatably move in accordance with the inclinations of the guide grooves 18 and 19. The engaging concave portions 5 in the rotative moving member 4 engage with the respective engaging projections 15 on the seal member 14. On this occasion, the rotative moving member 4 rotates against the force of the coil spring, which urges the rotative moving member 4 in a rotating direction. After engaging with the seal member 14, the rotative moving member 4 continuously rotates along the guide grooves 18 and 19. Accordingly, the rotating force of the rotative moving member 4 is transmitted to the seal member 14. The seal member 14 is also rotated. Then, once the ends 4*b*1 and 4*c*1 of the rotative moving member 4 reach lower ends 18*a* and 19*a* of the guide grooves 18 and 19, the ends of the rotative moving member 4 rotate in a direction opposite to the previous one owing to the urging force of the coil spring. The ends of the rotative moving member 4 are thus held at the same positions as those in an initial state. The liquid housing container 1 is firmly fixed to the holder 11 by the engagement between the lower ends 18*a* and 19*a* of the guide grooves 18 and 19 and the opposite ends (locking portions) 4*b*1 and 4*c*1 of the rotative moving member 4. The installing operation is thus completed.

Now, with reference top FIGS. 5A to 5C and 6A1 to 6D2, a step-by-step description will be given of a series of operations for installing the liquid housing container 1.

Figure 5A:
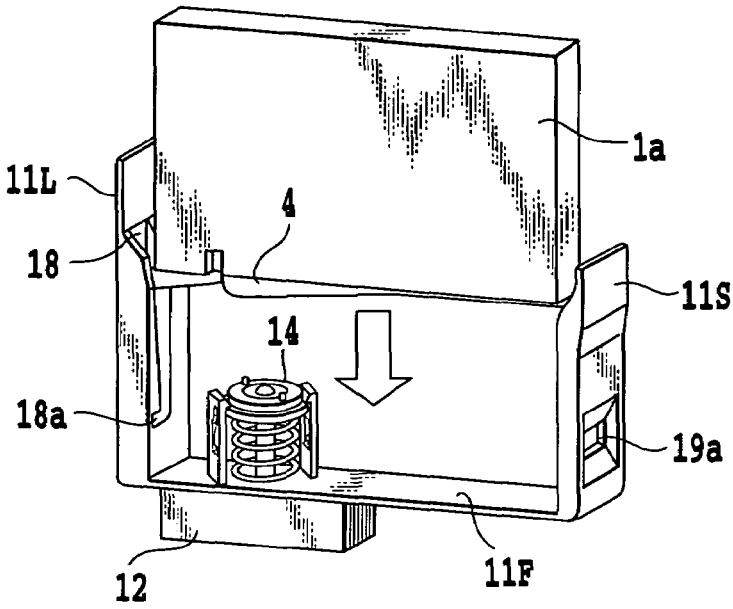
FIG. 5A is a perspective view showing a step executed in installing the liquid housing container in the holder; the liquid housing container has not been connected to a head liquid supplying tube.
Figure 5B:
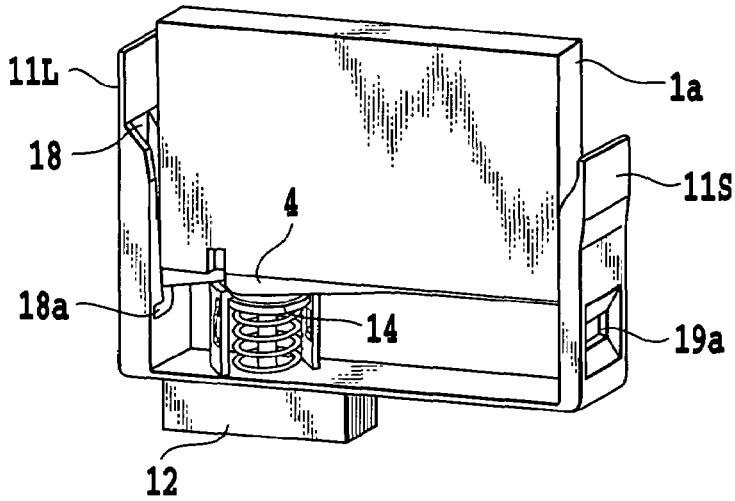
FIG. 5B is a perspective view showing a step executed in installing the liquid housing container in the holder; an engaging concave portion in a rotative moving member engages with an engaging projection on a seal member and the rotative moving member is inserted around a liquid supplying tube.
Figure 5C:
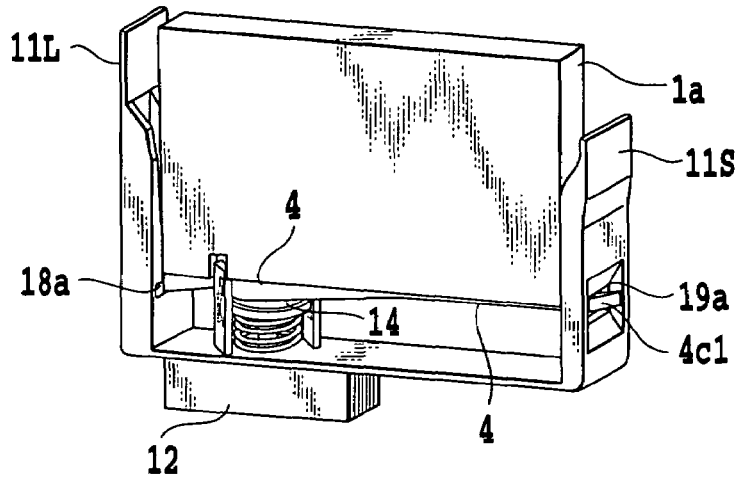
FIG. 5C is a perspective view showing a step executed in installing the liquid housing container in the holder; the liquid housing container has been completely installed.

FIGS. 5A to 5C show steps executed during an operation for installing the liquid housing container 1 and the head holder 11. FIGS. 6A1 to 6D2 show how the rotative moving member 4 and the seal member 14 operate in the step shown in FIG. 5.

FIGS. 5A, 6A1, and 6A2 are diagrams showing a state observed before the liquid housing container 1 is connected to the head liquid supplying tube 13. In FIG. 5A, the ends

4*b*1 and 4*c*1 of the rotative moving member 4 have been inserted into the upper parts of the guide grooves 18 and 19, formed in the respective sides 11L and 11S of the head holder 11. FIGS. 6A1 and 6A2 show the initial states of the rotative moving member 4 and seal member 14, which correspond to FIG. 5A. The seal member 14 is locked by the urging force of the coil spring 16 on key-like holding portions 17*b* of the seal holding members 17, provided on the holder 11. The rotative moving member 4 is urged clockwise in FIG. 6A2 by the coil spring (not shown). The arm portion 4*c* is held along a side of the housing container main body 1.

FIGS. 5B, 6B1, and 6B2 shows that the engaging concave portions of the rotative moving member 4 have been engaged with the engaging projections 15 of the seal member with the rotative moving member 4 inserted around the liquid supplying tube. That is, in FIG. 5B, the engaging concave portions of the rotative moving member 4 engage with the engaging projections 15 of the seal member 14. The rotative moving member 4 lowers rotatably while being guided through the guide groove 18. This causes the rotative moving member 4 and seal member 14 to be inserted around the liquid supplying tube 13 while being rotatably moved.

FIG. 6B1 shows how the seal member 14 operates in the state shown in FIG. 5B. As shown in the figure, the seal member 14, engaged with the rotative moving member 4, lowers while rotating clockwise.

FIG. 6B2 shows how the rotative moving member 4 operates in the state shown in FIG. 5B. The rotative moving member 4 moves along the guide groove 18 against the urging force of the coil spring to rotatably move clockwise as shown in the figure.

FIGS. 5C, 6C1, and 6C2 show that the liquid housing container 1 has been installed, that is, the liquid housing container 1 and the liquid supplying tube 13 have been connected together and fixed to the holder 11. At the position where the liquid housing container 1 is completely connected to the liquid supplying tube 13, the rotative moving member 4 functions as a member that fixes the housing container 1*a*. The opposite ends 4*b*1 and 4*c*1 of the rotative moving member 4 are rotated along the lower ends 18*a*1 and 19*a*1 of the guide grooves 18 and 19, respectively. As a result, the opposite ends 4*b*1 and 4*c*1 return to their initial positions (see FIG. 6C2). This engages the rotative moving member 4 with the lower ends of the guide grooves 18 and 19 for firm fixation. On this occasion, one end 4*c*1 of the elongate arm portion 4*c* of the rotative moving member 4 projects from the opening 19*a*. The end 4*c*1 is locked at the end of the opening 19*a*.

FIG. 6C1 shows how the liquid supplying tube 13 and the seal member 14 operate after the liquid housing container 1 has been installed. In this case, the seal member 14 lowers along the liquid supplying tube 13, with the liquid introducing port 13*a* in the liquid supplying tube 13 in communication with the liquid housing container 1.

Now, with reference to FIG. 7, description will be given of an operation for removing the liquid housing container 1.

Figure 7A:
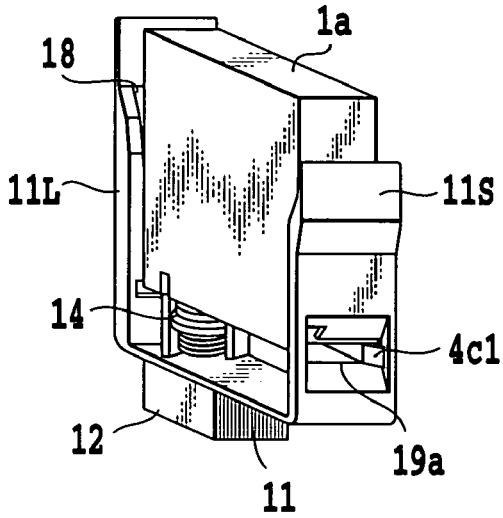
FIG. 7A is a perspective view showing an operation for removing the liquid housing container according to the first embodiment of the present invention, wherein the liquid housing container has been completely installed.

FIG. 7A shows that the liquid housing container 1 has been completely installed.

As previously described, the rotative moving member 4 has been engaged with and fixed to the opening 19*a*, formed in one 11S of the sides of the holder 11. In this case, as shown FIG. 7A, the end of the rotative moving member 4 has been moved and fixed to the right side.

Figure 7B:
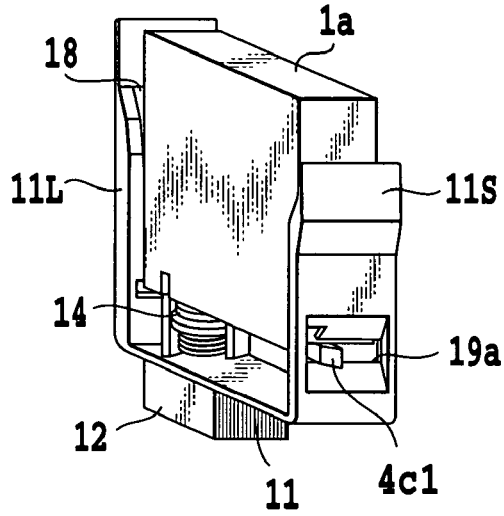
FIG. 7B is a perspective view showing an operation for removing the liquid housing container according to the first embodiment of the present invention, wherein the rotative moving member has been rotated in a removing direction.
Figure 7C:
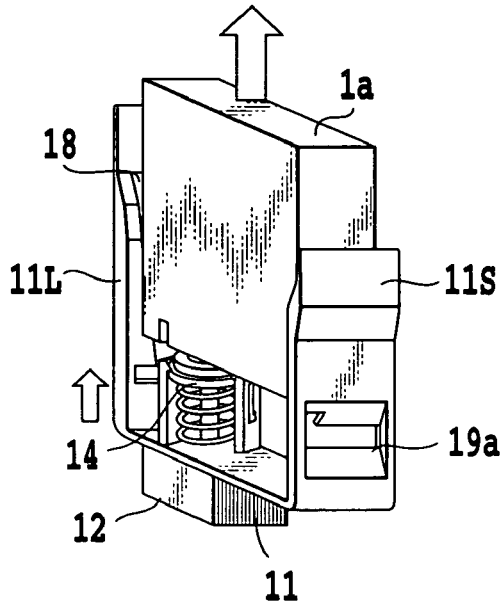
FIG. 7C is a perspective view showing an operation for removing the liquid housing container according to the first embodiment of the present invention, wherein the liquid housing container is being removed from the holder.

To remove the container, the end 4*c*1 of the rotative moving member 4, projecting from the opening 19*a*, is moved leftward in the figure along the opening 19*a*, the lower end of the guide groove 19, against the urging force of the coil spring (not shown) (see FIG. 7B). While installed in the holder 11, the liquid housing container 1 is subjected to the upward urging force of the coil spring 16. Thus, when the end 4*a*1 of the rotative moving member 4 is moved to the left end of the opening 1*a* to disengage from the opening 19*a*, the urging force of the coil spring 16 moves the rotative moving member 4 upward together with the housing container main body 1*a*, while rotating the rotative moving member 4 along the guide groove. The housing container main body 1*a* moves upward and substantially parallel to the opposite sides 11L and 11S of the holder 11 while having its posture regulated by the opposite sides 11L and 11S (see FIG. 7C). This allows the liquid housing container 1 to be removed.

In the first embodiment, a position for an operation for removing the liquid housing container 1 is provided at a rear surface of the holder 11. However, another member can be used to move the removing position to above or front of the liquid housing container 1.

In the description of the above embodiment, by way of example, the rotative moving member 4 is rotatably movably held around the supplying port seal portion 3, projected from the housing container main body 1*a*. However, the rotative moving member 4 may be separable from the housing container main body 1*a*, and it is possible to individually perform the operation of rotating the rotative moving member 4 and the operation of installing the housing container main body 1*a*.

One of the functions of the rotative moving member 4 according to this embodiment is to reduce an increase in operating force required if sticking, liquid fixation, or the like occurs between the liquid supplying tube 13 and the seal member 14, to maintain a stable installing force. Accordingly, the rotative moving member 4 may be separable from the housing container main body 1*a* so that the housing container can be installed after the problem such as sticking or liquid fixation has been solved by solely using the rotative moving member 4.

FIGS. 8A to 8D show a method for installing the housing container main body 1*a* if the rotative moving member 4 is separable from the housing container main body 1*a*.

Figure 8A:
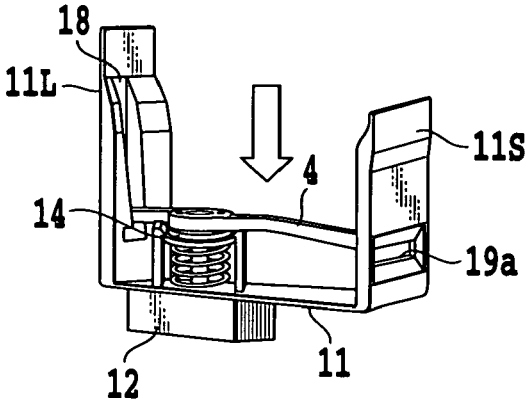
FIG. 8A is a perspective view showing a method for installation executed if the rotative moving member and the liquid housing container are separably configured according to the first embodiment of the present invention, wherein the rotative moving member has not been fixed to the holder.
Figure 8C:
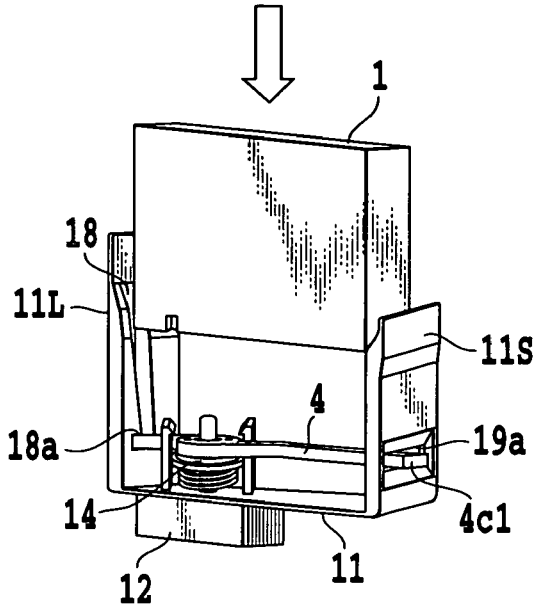
FIG. 8C is a perspective view showing a method for installation executed if the rotative moving member and the liquid housing container are separably configured according to the first embodiment of the present invention, wherein the housing container has not been installed.
Figure 8B:
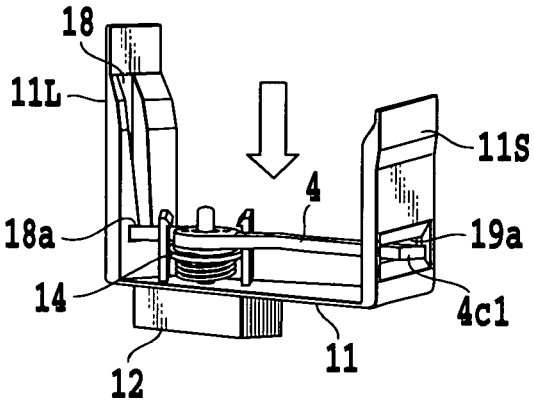
FIG. 8B is a perspective view showing a method for installation executed if the rotative moving member and the liquid housing container are separably configured according to the first embodiment of the present invention, wherein the rotative moving member has been fixed to the holder.
Figure 8D:
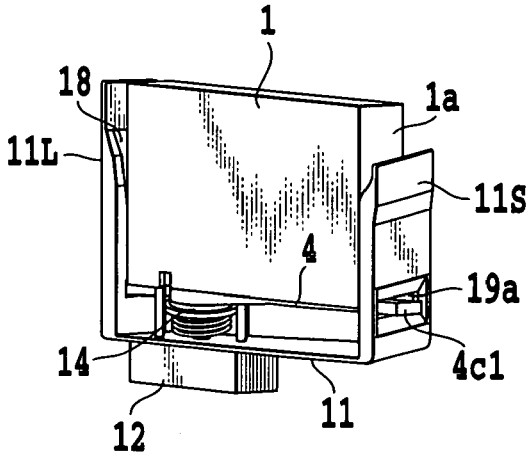
FIG. 8D is a perspective view showing a method for installation executed if the rotative moving member and the liquid housing container are separably configured according to the first embodiment of the present invention, wherein the housing container has been completely installed.

First, as shown in FIG. 8A, the engaging projections 15 of the seal member 14 are engaged with the engaging concave portions 5 of the rotative moving member 4 as in the case of the above installation. Then, the rotative moving member 4 is pressed downward along the guide groove 18 in the holder 11 while being rotatably moved with the seal member 14. Finally, the rotative moving member 4 is engaged with and fixed to the opening 19*a* in the guide groove 19 as shown in FIG. 8B. If the fixing operation is thus performed by solely using the rotative moving member 4, the urging force of the coil spring or the like is not exerted in contrast to the usual installation of the rotative moving member 4 with the housing container 1*a*. Thus, after the rotative moving member 4 has been pressed upward along the guide grooves 18 and 19, the rotative moving member 4 must be manually rotated along the lower ends 18*a* and 19*a* for fixation. Then, as shown in FIG. 8C, the housing container main body 1*a* is inserted into the holder 11 from above. The housing container main body 1*a* is then completely inserted around the liquid supplying tube 13 while fitting the liquid supplying tube 13 to the supplying port 2 (see FIG. 8D). To fix the housing container main body 1*a*, the housing container main body 1*a* and the rotative moving member 4 may be provided with engaging portions so that the engaging portions can be engaged with each other for fixation when the installation is completed. Alternatively, the housing container main body 1*a* may be solely engaged with and fixed to the holder 11. However, in the latter case, when the liquid housing container 1 is solely removed, the liquid introducing port 13*a* in the liquid supplying tube 13 is opened. When the liquid introducing port 13*a* remains open, the liquid may leak from the print head 12. Accordingly, it is desirable to use the former configuration, which enables the rotative moving member 4 and the housing container to be simultaneously removed.

As described above, according to the first embodiment, as the housing container main body 1*a* is linearly moved, the rotative moving member 4 rotatably moves relative to the housing container main body 1*a*. The rotative moving force is thus transmitted to the seal portion. This eliminates the needs for rotating the housing container main body 1*a* and for a large space for an attaching and detaching operations. As a result, the size of the whole apparatus can be reduced. Further, the engaging portions (engaging projections 15) of the seal member 14 engage with the engaged portions (engaging concave portions) 5 of the liquid housing container 1 near the supplying port 2. Accordingly, the alignment near the supplying port 2 reduces the misalignment between the liquid supplying tube 13 and the supplying port 2. Moreover, the rotative moving member 4 on the liquid housing container 1 rotates the seal member 14 to enable the suppression of fixation of the seal portion caused by ink evaporation and of an increase in installation force caused by, for example, sticking of the seal member 14. Therefore, the liquid housing member can be easily and smoothly installed. Further, the holder 11 also functions as a guide for the liquid housing container 1. The holder 11 can hinder the liquid housing container 1 from being tilted or moved in the rotating direction during attachment or detachment.

Second Embodiment

Now, a second embodiment of the present invention will be described.

Figure 9A:
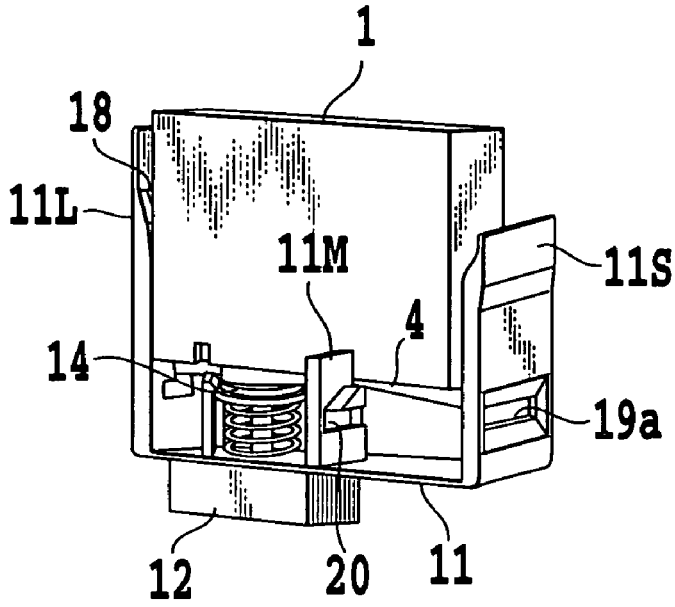
FIG. 9A is a perspective view showing a second embodiment of the present invention as well as the configuration of sides of the housing container and holder.
Figure 9B:
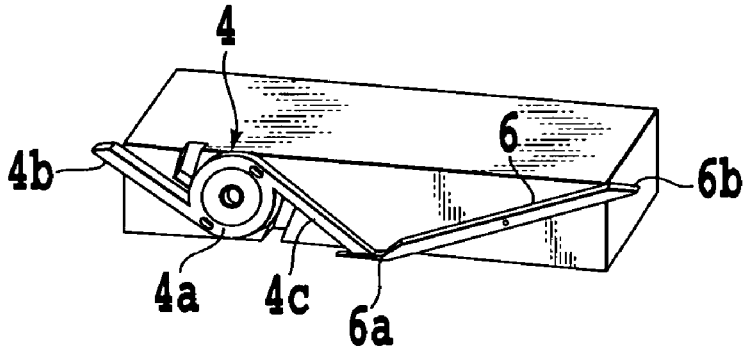
FIG. 9B is a perspective view showing the second embodiment of the present invention as well as the configuration of a bottom of the housing container main body.
Figure 9C:
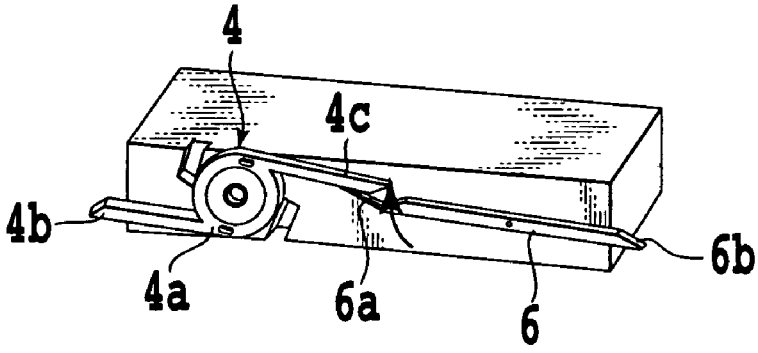
FIG. 9C is a perspective view showing the second embodiment of the present invention, wherein in the state shown in FIG. 9B, the rotative moving member is rotated.

FIGS. 9A, 9B, and 9C are perspective views showing a second embodiment of the liquid housing container 1 according to the present invention. FIG. 9A shows how the liquid housing container 1 is installed in the head holder 11. FIG. 9B shows the initial state of the rotative moving member 4. FIG. 9C shows an operation of the rotative moving member 4 performed when the liquid housing container 1 is removed. In FIGS. 9A to 9C, portions of the second embodiment which are the same as or correspond to relevant portions of the first embodiment are denoted by the same reference numerals. Their description is thus omitted.

In the first embodiment, the angle through which the rotative moving member 4 can be rotated is determined by the distance from the rotating center (the center of the supplying port 2) of the rotative moving member 4 to the end 4*a*1, with which the opening 19*a* is engaged. That is, the angle through which the rotative moving member 4 can be rotated is determined by the length of the arm portion 4*c* and the width of the opening 19*a* (the width of the housing container main body 1*a*). Accordingly, if a larger rotating angle is required to accomplish a stable operation force, the length of the arm portion 4*c* of the rotative moving member 4 must be reduced or the width of the opening 19*a* must be increased. However, when the width of the holder 11 is set equal to or larger than that of the housing container main body 1*a* in order to increase the width of the housing 19*a*, this affects the operation of removing the housing container main body 1*a*, the head size, or the size of the housing container main body 1*a*. Accordingly, the increase in the width of the opening 19*a* is limited.

Thus, the second embodiment is intended to increase the angle through which the rotative moving member 4 can be rotated without the need for increasing the width of the holder 11.

To accomplish this object, the second embodiment has such a configuration as shown in FIG. 9A. FIG. 9A is a perspective view showing the general configuration of the second embodiment. FIG. 9B is a perspective view showing the shape of the rotative moving member 4 and the like as viewed from the bottom surface of the housing container main body 1. FIG. 9C is a perspective view showing that the rotative moving member has been rotated.

As shown in FIG. 9B, in the second embodiment, the arm portion 4*c* of the rotative moving member 4 is formed to be shorter. That is, the second embodiment has a reduced length from the rotative moving center of the rotative moving member 4 to the end of the arm portion 4*c*. Further, with the reduced length of the arm portion c, a second side 11M having an opening 20 with which the end of the arm portion 4*c* is engaged is provided at an intermediate position on a bottom portion 11F of the holder 11 so as to extend in the vertical direction as shown in FIG. 9A.

By engaging the end 4*c*1 of the arm portion 4*c* with the opening 20 in the second side 1M, it is possible to increase the angle through which the rotative moving member 4 can be rotated without the need for increasing the width of the opening 20. However, the end 4*c*1 of the rotative moving member 4 is located inside the holder 11. It is difficult to operate the end 4*c*1 from front of the holder 11. Thus, a removing lever member 6 is rotatably movably provided on the bottom surface of the housing container main body 1*a* in such a way that one end 6*a* abuts against the end 4*c*1 of the rotative moving member 4, while the other end 6*b* is projected outward from the housing container main body 1*a*. This enables the other end 6*b* to engage with the opening 19, formed in the outer side 11S of the holder 11.

To remove the liquid housing container 1 from the holder 11, the end 6*b* of the lever member 6, which projects frontward from the opening 19*a*, is moved to rotate the rotative moving member 4 for removal as shown in FIG. 9C.

Third Embodiment

Now, a third embodiment of the present invention will be described with reference to FIG. 10.

In the third embodiment, a protective member 7 is provided in order to protect the rotative moving member 4, disposed on the bottom surface of the liquid housing container 1. The rotative moving member 4 is provided on the bottom surface of the housing container main body 1*a* because it rotatably moves around the supplying port 2. Consequently, the rotative moving member 4 may be broken if it is inadvertently subjected to a large force exerted by an external source. Thus, in the third embodiment, the periphery of the rotative moving member 4 is covered with the protective member 7 to prevent an external force from being applied directly to the rotative moving member 4. The protective member 7 has a three-face structure with a right and left sides and a bottom surface and has substantially the same length as that of the housing container main body 1*a*. Thus, the protective member 7 covers the whole rotative moving member 4 except for the opposite ends 4*b*1 and 4*c*1. Further, the opposite ends 4*b*1 and 4*c*1 of the rotative moving member 4 project outward from respective openings formed in the opposite ends of the protective member 7. This enables the rotative moving member 4 to move rotatably and engage with the guide groove in the holder 11. Further, grooves 7*a* and 7*b* are formed at respective ends of the protective member 7 to avoid interference with the seal portion holding member of the holder 11. Thus, the rotative moving member 4 can be installed in the holder 11 with the protective member 7 installed.

Figure 10A:
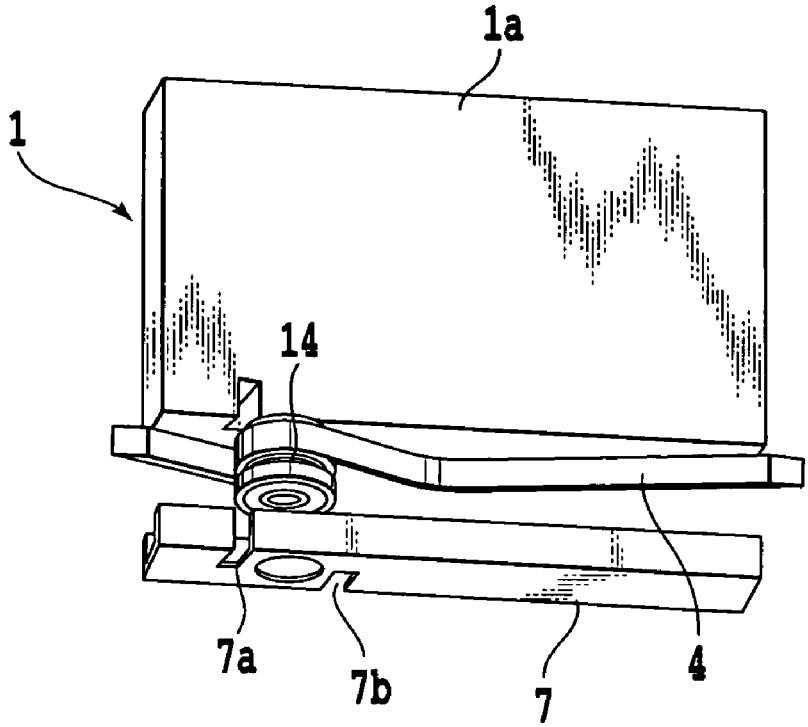
FIG. 10A is a perspective view showing a third embodiment of the present invention, wherein a protective member has been removed from the housing container main body.
Figure 10B:
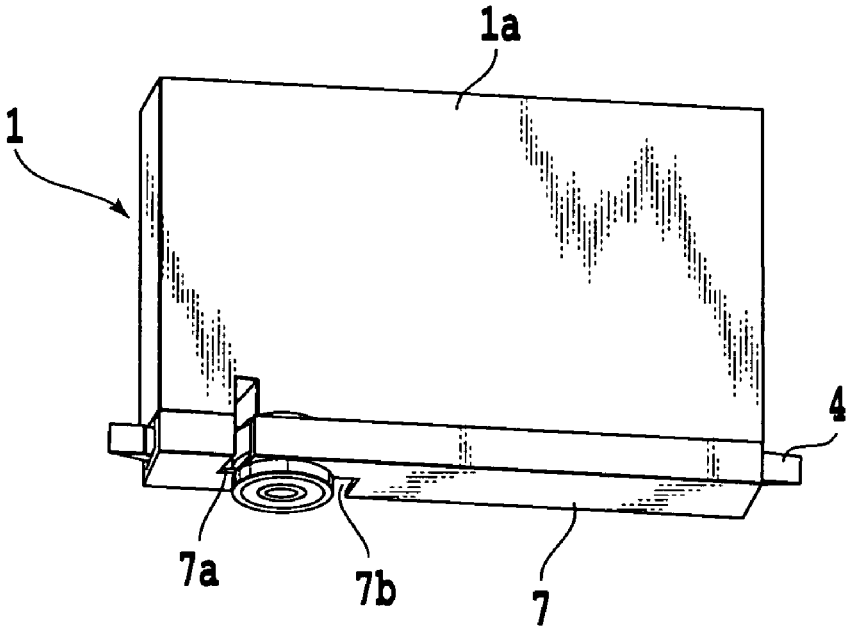
FIG. 10B shows how the protective member is attached to the housing container main body.

In FIG. 10, the protective member 4 is provided for the rotative moving member 4 according to the first embodiment. However, the rotative moving member 4 is also effective in protecting the rotative moving member 4 and removing lever 6, shown in the second embodiment.

(Another Shape of Rotative Moving Member)

The rotative moving member 4 is not limited to the ones shown in the above embodiments but may be shaped in a different manner.

FIG. 11 shows an example of another configuration of the rotative moving member 4.

Figure 11A:
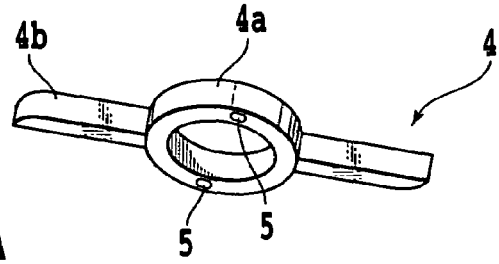
FIGS. 11A to 11D are perspective views showing another example of the configuration of the rotative moving member 4.
Figure 11B:
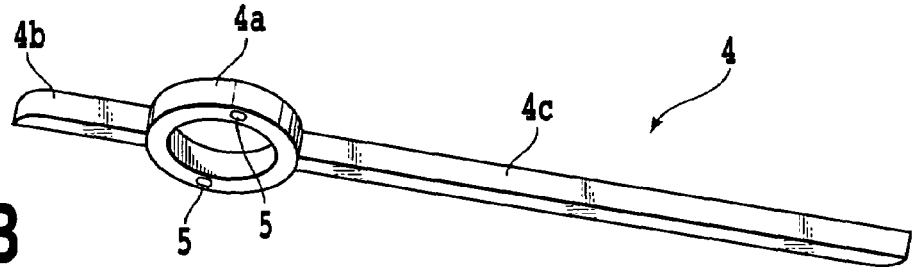

The rotative moving members 4 shown in FIGS. 11A and 11B have the pair of arm portions 4*b* and 4*c* projected from an annular portion 4*a* along the same straight line passing through the center of the annular portion 4*a* (rotative moving center); the annular portion 4*a* can be fitted around and removed from the supplying port seal portion 3 of the housing container main body 1*a*. In the rotative moving member 4 shown in FIG. 11A, one 4*c* of the arm portions is relatively short as shown in the second embodiment. In the rotative moving member 4 shown in FIG. 11B, one 4*c* of the arm portions is elongate as shown in the first embodiment. In this manner, the arm portion of the rotative moving member has only to be able to move along the guide groove in the holder in the vertical direction and to be able to engage with the holder when the installation is completed. That is, the length of the arm portion of the rotative moving member can be appropriately varied depending on the configuration of the holder.

In the rotative moving member 4 shown in FIG. 1C, a pair of linear arm portions 4*c* and 4*d* is projected from opposite positions in the annular portion 4*a* in a tangential direction.

In the rotative moving member 4 shown in FIG. 1D, one 4*c* of the arm portions 4*b* and 4*c* projected from the annular portion 4*a* is bent or non-linearly shaped.

(Another Configuration)

In the above embodiments, the rotative moving member attached to the housing container main body is engaged with the seal member or the rotative moving member is solely rotated. However, the rotative moving member may be pre-integrated with the seal member.

(Printing Apparatus)

Figure 12:
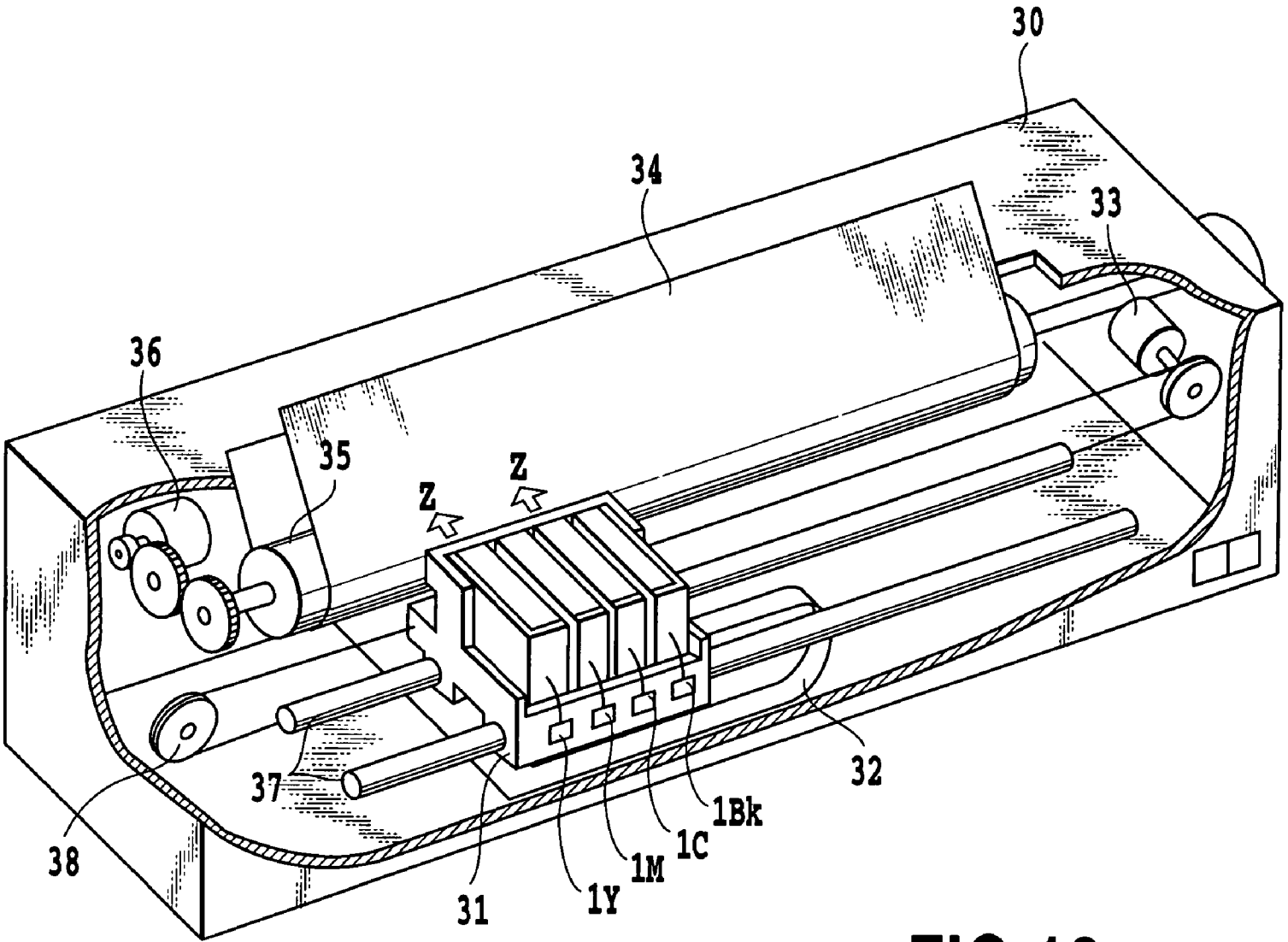
FIG. 12 is a partly cutaway perspective view showing an embodiment of a printing apparatus according to the present invention.

FIG. 12 is a partly cutaway perspective view showing an embodiment of a printing apparatus 50 having the structure in which the liquid housing container is installed according to the present invention.

In FIG. 12, the liquid housing container 1 in which various liquids are housed is fixed to a carriage 31. The liquid housing container 1 and the carriage 31 can be reciprocated along a shaft 37 in a longitudinal direction. Further, the liquid housing container 1 can be positioned on the carriage 31 by using, for example, a hole formed in the print head 12 and a boss on the carriage 31. Moreover, electric connections can be established by coupling a connector on the carriage 31 to a connection pad provided on a circuit board (not shown) for an ejecting section or forming a contact for a card edge connector.

A liquid ejected from an ejection port in the print head impacts a print medium 54 having its print surface regulated by a plate roller 55 so as to maintain a very small spacing between the print medium 54 and the print head 12. An image is thus formed on the print medium 54.

The print head 12 is appropriately supplied with an ejection signal from a data source (not shown) via a cable 52 and a terminal coupled to the cable 52, the ejection signal corresponding to image data. In the printing apparatus shown in the figure, one or more (in the figure, four) liquid housing containers 1 may be installed depending on the liquids used.

Further, in FIG. 12, the apparatus has a carriage motor 53 used to scan a carriage 51 along a shaft 57, a wire 58 that transmits the driving force of the motor to the carriage 51, and a feed motor 56 coupled to the platen roller 55 to convey the print medium 54.

The printing apparatus 50 shown in FIG. 12 is only an example. The print head 12 or the like is applicable which has the installing structure enabling the attachment and detachment of the liquid housing container 1 according to the present invention.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes.

This application claims priority from Japanese Patent Application No. 2004-169111 filed Jun. 7, 2004, which is hereby incorporated by reference herein.

What is claimed is:

1. A liquid supplying apparatus which supplies a liquid to a print head, the, apparatus comprising:

a liquid supplying tube projected from the print head and having a liquid introducing port which is in communication with the print head;

a seal member rotatably movably held on the liquid supplying tube, the seal member being movable from a position at which the liquid introducing port is closed to a position at which the liquid introducing port is opened;

a housing container main body in which the liquid is housed, the housing container main body having a liquid supplying port into and from which the liquid supplying tube can be inserted and removed; and a movable member which rotatably moves the seal member, wherein the print head is provided with a holder which holds the housing container main body, and the holder is provided with a guide groove which allows the movable member to move rotatably while moving forward or backward with respect to the seal member.

2. The liquid supplying apparatus according to claim 1, wherein the movable member is rotatably movable and can be engaged witH and detached from the seal member, and when rotatably moved while being engaged with the seal member, the movable member rotatably moves the seal member.

3. The liquid supplying apparatus according to claim 1, wherein engaging portions are provided on opposite surfaces of the movable member and seal member and can be engaged with each other.

4. The liquid supplying apparatus according to claim 1, wherein the movable member is provided on the housing container main body and is rotatably movable around the liquid supplying port.

5. The liquid supplying apparatus according to claim 1, wherein while moving in a direction in which the liquid supplying port is inserted around or removed from the liquid supplying tube, the movable member rotatably moves the seal member.

6. The liquid supplying apparatus according to claim 4, wherein the movable member has an annular portion that rotatably movably fits around a periphery of the supplying port of the housing container main body and an arm portion projected from the annular portion, and the arm portion is movably fitted and inserted into the guide groove.

7. The liquid supplying apparatus according to claim 4, wherein the movable member has a locking portion that can be engaged with and detached from the holder, and the locking portion and the holder are locked on each other to fix the housing container main body installed in the holder.

8. A liquid housing container from which a liquid is fed via an ink liquid supplying tube, the container being detachable from a print head having a liquid introducing port formed in the liquid supplying tube and which can be closed by a seal member rotatably movably supported on the liquid supplying tube, the container comprising:

a housing container main body having a liquid supplying port into and from which the liquid supplying tube can be inserted and removed; and a movable member which rotatably moves the seal member, the movable member having an engaging portion for fixation to the print head, wherein the movable member is movable at the engaging portion engaging with the print head, in union with an operation of attaching or detaching the liquid housing container to or from the print head.

9. The liquid housing container according to claim 8, wherein the movable member is rotatably movable around the liquid supplying port.

10. The liquid housing container according to claim 8, wherein ink is housed in the liquid housing container.

* * * * *

UNITED STATES PATENT AND TRADEMARK OFFICE

CERTIFICATE OF CORRECTION

PATENT NO. : 7,311,388 B2
APPLICATION NO. : 11/140918
DATED : December 25, 2007
INVENTOR(S) : Hideki Ogura et al.

It is certified that error appears in the above-identified patent and that said Letters Patent is hereby corrected as shown below:

COLUMN 7

Line 9, “in side” should read --inside--.

COLUMN 12

Line 26, “second side 1M,” should read --second side 11M--.

COLUMN 13

Figure 11C:
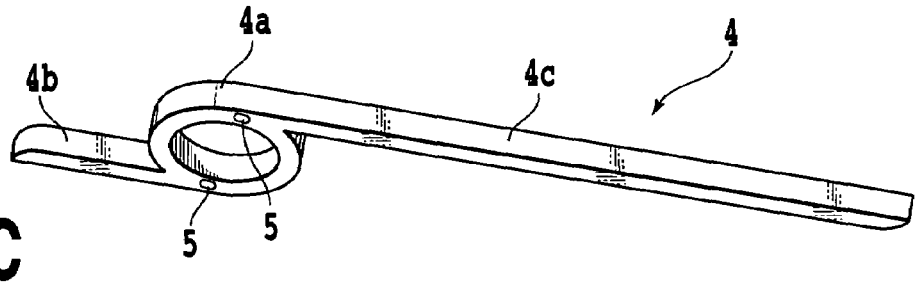
Figure 11D:
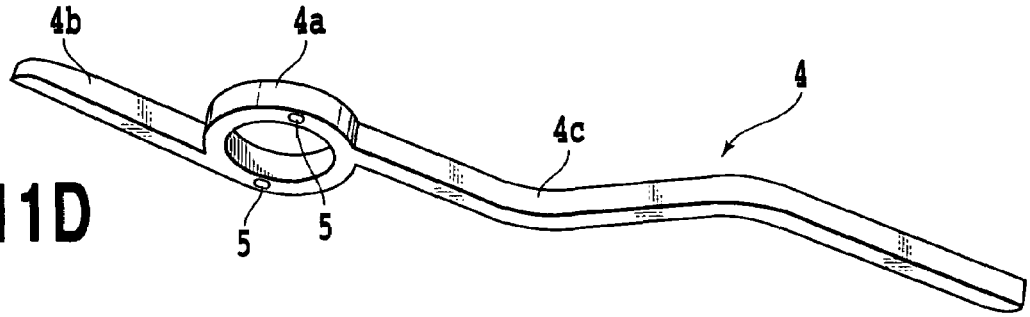

Line 38, “FIG. 1C” should read --FIG. 11C--; and
Line 41, “FIG. 1D” should read --FIG. 11D--.

COLUMN 14

Line 34 claim 1, “the,” should read --the--; and
Line 56 claim 2, “witH” should read --with--.

Signed and Sealed this

Twelfth Day of August, 2008

JON W. DUDAS
*Director of the United States Patent and Trademark Office*